United States Patent [19]

Reichenberger

[11] 4,236,553

[45] Dec. 2, 1980

[54] BEVERAGE PORTION CONTROLLER

[76] Inventor: Arthur M. Reichenberger, 1916 N. 21st Pl., Phoenix, Ariz. 85006

[21] Appl. No.: 54,469

[22] Filed: Jul. 3, 1979

[51] Int. Cl.[3] ..... B65B 3/04

[52] U.S. Cl. ..... 141/198; 141/95; 141/361; 141/367

[58] Field of Search ..... 141/94–96, 141/100–107, 192–229, 250–284, 351–362, 367, 378, 84

[56] References Cited

U.S. PATENT DOCUMENTS

| | | | |
|---|---|---|---|
| 1,149,256 | 8/1915 | Godfrey | 141/361 |
| 2,938,551 | 5/1960 | Hallstein | 141/227 |
| 3,916,963 | 11/1975 | McIntosh | 141/198 |

*Primary Examiner*—Houston S. Bell, Jr.

[57] ABSTRACT

An electronic controller for solenoid valve actuated beverage dispensers which allows the operator to automatically dispense properly filled cups of various sizes. Slideably mounted electronic probe is lifted by the lip of the cup positioned under the dispenser spout. Actuation of a switch energizes the solenoid valves starting the dispensing cycle. When the cup is filled to the level of the probe, the solenoid valves are de-energized. Early de-energization of the solenoid valves by bubbles is avoided by adjusting a time delay-off knob so that the proper level will be attained for each class of beverage. Too much or too little ice in the glass will not affect the level. Digital counters record the number of drinks served by size or price.

10 Claims, 3 Drawing Figures

BEVERAGE PORTION CONTROLLER

BACKGROUND OF THE INVENTION

Conventional carbonated beverage dispensers usually have a base or driptray, a back support or tower containing the ingredient supply lines from remote pressurized tanks, a dispenser head spaced above the driptray containing two solenoid actuated valves, one for carbonated water, and the other for syrup. These valves are controlled by a normally open switch actuated by a pivotally mounted lever depending from the dispenser head. The lever is moved by the lateral pressure of a cup when it is held manually under the spigot. The ingredients dispense as long as the solenoid valves remain energized through the closing of the momentary switch with pressure from the side of the cup. Removal of the cup allows the switch to re-open de-energizing the dispenser solenoid valves. Automatic dispensers have been developed which employ a timer to turn off the flow and allow the operator to attend to other matters while the cup is filling. These save time, but in many cases they cause the waste of ingredients. If too little ice is put in the cup, the timer underfills the cup and the operator has to top it off manually and this takes extra time. To make sure the cup is not underfilled, the operator soon learns that if he puts a little extra ice in the cup, he will not have to top it off; the cup runs over wasting the ingredients, but is saves him time. The present invention employs an electronic lever detector developed for my previous U.S. Pat. No. 3,688,947, to stop the flow of ingredients when the level in the cup reaches and wets the electronic probe which depends into any cup, regardless of size.

Electronic liquid level detectors have been used previously to control the quantity of liquid dispensed into cups or other containers as disclosed in U.S. Pat. Nos. 2,898,954; 3,357,461 and 3,916,963. In each case, the flow is initiated when the cup or receptacle is placed in the receiving position, and is halted when the liquid dispensed reaches the predetermined level where the electronic probes are wetted. The opening of the dispensing solenoid valves is accomplished automatically by a coin or by a lever operated switch. U.S. Pat. No. 3,916,963 employs an extension to the normal switch actuating lever so the lateral movement of the cup actuates the switch in the same manner as most manually actuated present-day dispensers.

The mechanical lever extensions are formed in an S configuration so that part of them extends into the cup to serve as electronic probes. This lever extension must be adjusted to accommodate one particular size cup by set screws and, if any other size cup was used, the lower ends would have to be cut off to a precise length. If the lower portion of the lever extensions are to be used as electronic probes for a smaller cup, the dispensing solenoid valve would first have to be actuated by the lateral movement of the cup, and the cup would then have to be tilted and placed under the probes, all while the beverage is being dispensed.

SUMMARY OF THE INVENTION

The present invention provides an electronic control, assembly replacing the normal lever operated switch, with a slideably attached probe means which is liftable by the rim of any size cup. Actuation of momentary switch latches solenoid valves on to start dispensing liquid into the cup. When the level of the liquid rises to wet the probe means, the solenoid valves are de-energized.

Accordingly, it is an object of the present invention to provide a beverage dispenser controller which will automatically fill any size cup or glass without pushing buttons.

Another object of the invention is to provide a beverage dispenser controller means which will prevent the overflow or underfill of any size cup, regardless of the quantity of ice in the cup.

Another object of the invention is to provide a beverage dispenser control means which will not require the attention of the operator while the cup is filling and allow him to perform other tasks.

Another object of the invention is to provide an easily attachable encapsulated water-proof controller which can be attached to any existing dispenser replacing the normal lever actuated switch providing automatic control.

Another object of the invention is to provide a means of recording the quantity of all drinks served from multiple dispensers according to price or the size of the cup, such as small, medium and large. The dollar value of all drinks dispensed can be reconciled with the cash register.

Another object of the invention is to provide a means of compensating for too many bubbles or foam by adjustably delaying the turn off of dispenser valves.

Another object of the invention is to provide a beverage dispenser controller utilizing a liquid sensing circuit requiring only one probe and employing the liquid in the stream from the spigot as a conductive portion of the circuit.

Further objects and advantages of the invention may be apparent from the following specifications, appended claims and accompanying drawings.

DESCRIPTION OF THE PREFERRED EMBODIMENTS

Figure 1:
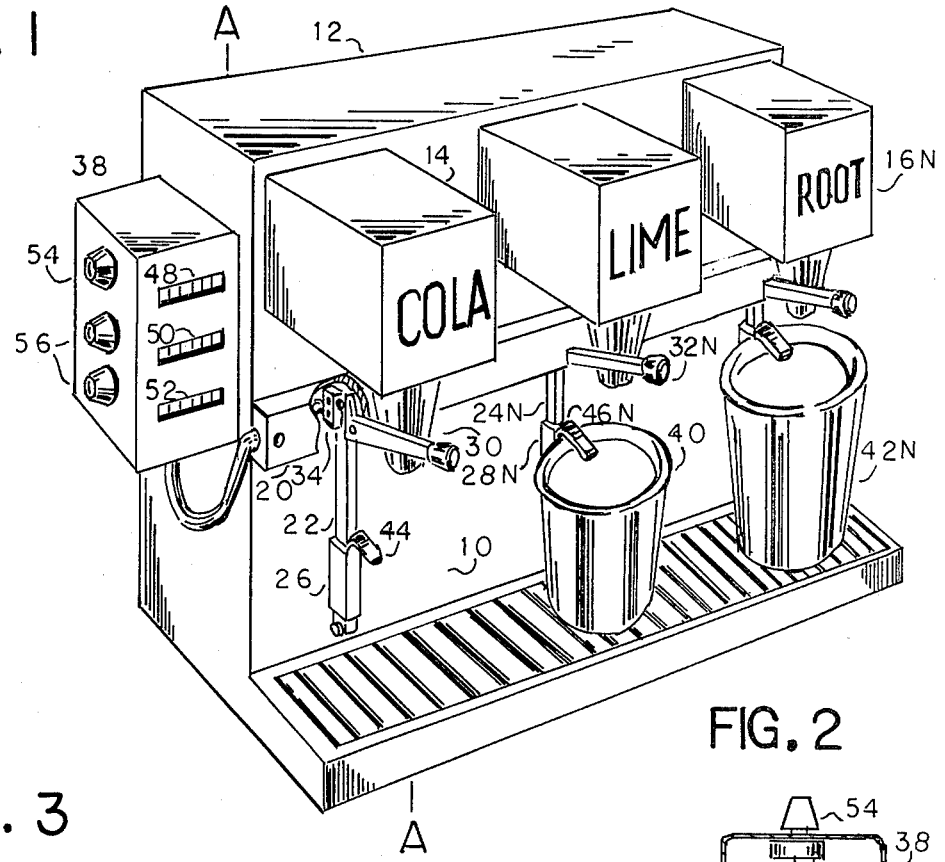
FIG. 1 is a perspective view of a multiple brand soft drink dispenser showing a remote electronic portion controller with digital display, a switch housing as it is attached beneath the dispenser heads on the back panel with actuating lever extending outwardly, and conductive elements slideably attached to fixed rods and shown with no cup in place, a small cup in place, and a large cup in place.

Reference is hereby made to FIG. 1 which generally illustrates a view in perspective of a typical soft drink dispensing station often seen in fast food stores. There is usually one dispenser head for each class of beverage, each having two solenoid operated control valves; one for syrup and one for carbonated water. There is usually a lever operated switch not shown here, to energize the aforementioned solenoid valves, allowing the pressurized syrup and carbonated water from a remote supply to mix in the nozzle and drop into the serving cup which is usually held in the operator's hand. Mounted on the back plate 10 of multiple dispenser 12 below dispenser heads 14 and 16N is switch and probe housing 20. Probes elements 26 and 28N are slideably mounted on fixed rods 22 and 24N to allow vertical movement. Manual raising of switch lever 30 or 32N will actuate switch 34, starting the dispensing cycle, as seen in cutaway drawing of housing 20.

An integral part of the probe element 26 is a conductive angled projection 44 or 46N configured to depend over the rim of cups 40 and 42N to make contact with the beverage when it fills to the pre-determined level signaling the electronic control to turn off the solenoid valves of the dispenser.

Control housing 38 contains recorders 48, 50 and 52 to display the number of small, medium and large size drinks dispensed respectively.

Also shown on housing 38 are adjustable time delay control knobs 54 and 56N to compensate for the amount of bubbles produced by each type drink from dispenser heads 14 and 16N by delaying the turn-off more when there are more bubbles and less when there are fewer bubbles.

Switch levers 30 and 32N may be raised manually to actuate switch 34 starting the dispensing cycle.

Figure 2:
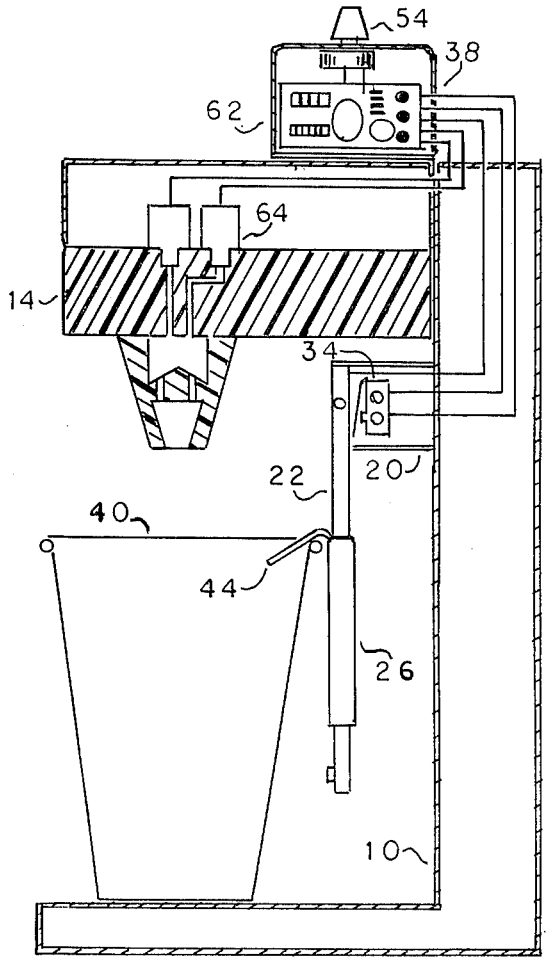
FIG. 2 is a vertical sectional view of a typical beverage dispenser with a probe element positioned to slideably depend over the edge of a cup; and a switch means actuated by the probe means as the cup is placed in the receiving position.

Reference is hereby made to FIG. 2, which is a vertical sectional view of one segment of dispenser 12 of FIG. 1, along lines A—A. Components include back plate 10, dispenser head 14, probe element 26, angled projection 44, probe rod 22, pivotably mounted on switch and probe housing 20, so that switch 34, can be actuated by the lateral movement of cup 40.

This alternate configuration eliminates the need for switch lever 30, since switch 34 is positioned to be actuated by the lateral movement of probe rod 22, when the rim of cup 40 is moved into a dispensing position.

Control housing 38, re-positioned in this drawing for a better view, time delay off control knob 54, control circuit board 62 containing components necessary to start, stop and record the dispensing of any beverage.

Actuation of switch 34 signals control 62 to latch solenoid valves 64 open. When the cup 40 fills to the level of the angled projection 44, current is conducted through the liquid to un-latch solenoid valves 64 and stop the flow. A lateral movement of cup 40 will cause the rim to slide along the underneath side of the angled projection 44 with a camming action to raise the probe 26 vertically, allowing the removal of the cup.

Figure 3:
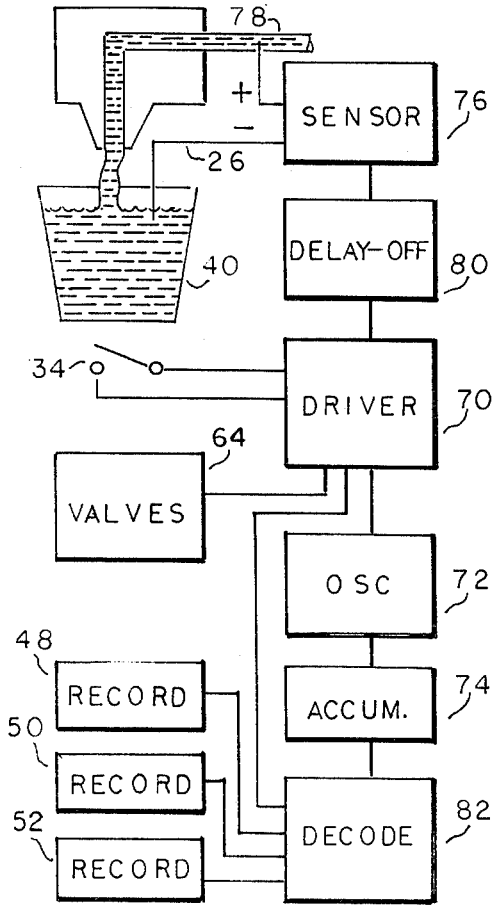
FIG. 3 is a block diagram of an electronic control circuit which replaces the normal switch actuated by the pivotal movement of a lever.

Reference is hereby made to FIG. 3 which is a block diagram of the electronics necessary to control one dispenser head with count display for number of cups filled of three different sizes. It is to be understood that a complete system would have six circuits with all counts of the number of cups fed into its respective decoder and registered on the same three count recorders 48, 50, and 52.

Actuation of switch 34, latches solenoid driver 70 to an on state which energizes solenoid valves 64, and enables oscillator 72 to start pulsing accumulator 74.

Sensor circuit 76, changes state when probe 26 detects liquid in cup 40 when current is passed through the stream of liquid 78, from one side of the power source to the probe 26. In essence, the stream 78 becomes one of the conductive probes.

When sensor circuit 76 changes state, it starts the adjustable delay off timer 80, and after a pre-set time, disables solenoid driver 70.

Solenoid driver 70 then de-energizes solenoid valves 64, and signals decoder 82 to select the proper recorder 48, 50 or 52 determined by the count in the accummulator 74. For example, a small count representing a short period of time for topping off a cup would not be recorded. A larger count representing a longer period of time would be registered on the small cup size recorder 48, a larger count representing a longer pouring time would be registered on the medium cup size recorder 50, a larger count representing a still longer pouring time would be registered on the large cup size recorder 52.

Also, when probe 26 is wetted probe sensor circuit 76 actuates adjustable time delay off circuit 80, to disable solenoid driver 70 de-energizing beverage solenoid valve 64 to stop the flow of syrup and carbonated water.

Since there are variable factors, such as temperature, amount of carbonation and syrup content that cause more or fewer bubbles from day to day, it becomes necessary to compensate for the early triggering of the probe sensor circuit 76 by bubbles. For example, a high head of bubbles would turn off the flow early and leave the cup less than full when the bubbles settle down. An adjustable time delay off 80, allows the beverage solenoid valves to stay open enough longer to fill the cup to the desired level.

It will be understood that various modifications of the electronics or disclosed structure will occur to those skilled in the art and it is intended that they be limited only in accordance with the appended claims.

I claim:

1. In a beverage dispenser including:

a nozzle for discharging liquid, a cup supporting means positioned below said nozzle for receiving a cup having a rim;

a solenoid controlled valve for controlling the discharge of said liquid from said nozzle;

probe means engageable with the rim of said cup for making electrical contact with said liquid dispensed into said cup; and control circuit means electrically connecting said probe means and said solenoid control valve for actuating said valve to stop the dispensing of said liquid into said cup when said liquid attains a predetermined level in said cup;

improvements therein for automatically positioning said conductive probe means to accommodate cups of varying heights, said improvements comprising:

a probe and switch support housing carrying said probe means;

said probe means being slideably mounted for reciprocal vertical movement; and switch means, fro activating said solenoid control valve to initiate the dispensing of said liquid into said cup.

2. The improved beverage dispenser of claim 1, wherein said switch means is manually operable.

3. The improved beverage dispenser of claim 2, including a lever having a first end pivotally connected to said support housing and communicably with said switch means and having a second free end extending outwardly from said housing, said switch means being actuated in response to movement of said free end.

4. The improved beverage dispenser of claim 1, wherein said probe means includes:

a. a probe rod having an upper end pivotally connected to said support housing and having a lower free end; and b. a probe element slideably carried by said probe rod, said probe element normally residing proximate the lower end of said probe rod in response to gravity and liftable by the rim of said cup.

5. The improved beverage dispenser of claim 4, wherein said probe element includes a rim engaging portion for receiving the rim of said cup.

6. The improved beverage dispenser of claim 5, wherein said probe element further includes an angled projection extending from said rim engaging portion to a point lower than the rim of said cup for electrical contact with said liquid and having an inclined under surface providing a camming action to lift said probe element when said cup is removed laterally.

7. The improved beverage dispenser of claim 1, wherein said control circuit means includes:

a. timing means for detecting the duration of dispensing and emitting a first signal for a duration between a first and second pre-determined time and emitting a second signal for a duration between a second and third pre-determined time, b. a first recorder for receiving and recording the number of first signals, and c. a second recorder for receiving and recording the number of said second signals.

8. The improved beverage dispenser of claim 1, wherein said control means includes:

adjustable time delay means for delaying the actuation of said solenoid valve to stop the dispensing of said liquid after electrical contact is made by said probe means and said liquid.

9. The improved beverage dispenser of claim 1, wherein said control circuit means includes an electronic liquid sensing circuit means wherein said liquid being dispensed through said nozzle into said cup forms a conductive portion of said liquid sensing means.

10. The improved beverage dispenser of claims 6 or 9, wherein said conductive portion of said liquid sensing means includes said angled projection.

* * * * *